United States Patent [19]

Hammond

[11] Patent Number: 4,703,745

[45] Date of Patent: Nov. 3, 1987

[54] ARROW RETENTION ATTACHMENT FOR BOW

[76] Inventor: David R. Hammond, 3462 Druck Valley Rd., York, Pa. 17402

[21] Appl. No.: 914,927

[22] Filed: Oct. 3, 1986

[51] Int. Cl.[4] ..... F41D 10/00

[52] U.S. Cl. ..... 124/41 A

[58] Field of Search ..... 124/41 A, 24 R, 25, 124/88

[56] References Cited

U.S. PATENT DOCUMENTS

| | | | |
|---|---|---|---|
| 2,413,669 | 12/1946 | Whitcombe | 411/85 |
| 2,743,716 | 5/1956 | Wendt | 124/41 A |
| 2,777,435 | 1/1957 | Brooks | 124/41 A |
| 3,760,788 | 9/1973 | Hartman | 124/41 A |
| 4,038,960 | 8/1977 | Ludwig | 124/41 A |
| 4,170,980 | 10/1979 | Killian | 124/41 A |
| 4,318,390 | 3/1982 | Trotter | 124/41 A |
| 4,332,232 | 6/1982 | Troncoso | 124/24 R |
| 4,398,528 | 8/1983 | Troncoso | 124/24 R |
| 4,489,704 | 12/1984 | Troncoso | 124/24 R |

*Primary Examiner*—Leo P. Picard
*Assistant Examiner*—Benjamin Layno
*Attorney, Agent, or Firm*—C. Hercus Just

[57] ABSTRACT

An attachment for a bow to be used in cooperation with known supports which engage respectively a side of an arrow and also the lower surface of an arrow. The attachment has a flexible leaf and a cam head. An arrow is mounted to the known supports by moving the arrow shaft laterally against the cam head flexing the leaf upwardly. As the arrow shaft moves past the cam head the leaf snaps back downwardly pressing the arrow against the aforementioned known supports, whereby the attachment acts to prevent an arrow from laterally falling from the bow when mounted on the bow in any shooting position of the bow but not interfering with longitudinal movement of the arrow from the bow when shot therefrom.

5 Claims, 7 Drawing Figures

ARROW RETENTION ATTACHMENT FOR BOW

BACKGROUND OF THE INVENTION

The sport of archery has enjoyed wide expansion in recent years and the development of attachments and devices to increase the accuracy in the shooting of arrows has resulted in the development of a relatively wide range of improvements and attachments, as well as in the basic construction of bows, especially for purposes of increasing power as is desired in bows used for hunting purposes. In the use of bows for hunting, it is frequently necessary to hold the bow in peculiar positions different from a normal upright position as, for example, in target shooting. For example, when an arrow is disposed against one face of a bow and is supported in such position by suitable known means, it is sometimes necessary to hold the bow in a substantially horizontal position with the arrow disposed against the lower face in such position, whereby conventional positioning means will not retain the arrow against the bow under such conditions and the arrow falls from engagement with the bow, sometimes at a very crucial time, as when a hunted object is cited and shooting is desired. The present invention pertains to an improvement in means to preventing an arrow from falling from a shooting position with respect to the bow, under such circumstances as described above.

In relatively modern bows used for both target shooting and hunting, it has become customary to provide a relatively wide notch in one face of the bow substantially midway thereof, and this is sometimes known as a window within which an arrow is disposed, frequently by some type of positioning members which, in the main, consists of an abutment or plunger which engages the side of an arrow when disposed in the window and a supplemental support engages the lower surface, for example, of an arrow when positioned for shooting.

For normal shooting, such aforementioned positioning members are adequate and typical examples of such means comprise the subject matter of the following prior U.S. Pat. Nos.:

| | | |
|---|---|---|
| 3,760,788 | Hartman | Sept. 24, 1973 |
| 4,170,980 | Killian | Oct. 16, 1979 |
| 4,318,390 | Trotter | Mar. 9, 1982 |
| 4,332,232 | Troncoso, Jr. | June 1, 1982 |
| 4,398,528 | Troncoso, Jr. | Aug. 16, 1983 |
| 4,489,704 | Troncoso, Jr. | Dec. 25, 1984 |

Among the foregoing patents, attention is directed to Killian, and Troncoso, Jr., '528 and '704, which all show laterally disposed plungers positioned to engage one side of the arrow which is closest to the face of the bow from which the arrow is projected and, in addition, additional means are shown which engage the lower surface of the arrow when disposed in shooting position but, in the main, it readily can be visualized that if, for example, the bow is disposed horizontally with the window lowermost, the illustrated positioning means are not sufficient to retain the arrow in shooting position within the window.

The aforementioned patent to Hartman discloses a bracket having spaced parallel edges which respectively engage lower portions of the shaft of an arrow and primarily are designed to accommodate an arrow with the feathers or fletches not engaging any part of the support means when said fletches move outwardly from the same.

Troncoso, Jr. '232, in FIG. 4, shows the shaft of an arrow securely wedged by a pair of members against one face of the window of the bow, but this position is indicated as being a locked position from which an arrow cannot be shot, since the shooting position is shown in different figures from that of the locked position.

The patent to Trotter shows a relatively complex mechanism for securing an arrow in shooting position within the window of a bow but the same is a complete assembly as distinguished from a single attachment adapted to be employed with other known rests or positioning means commonly used at present in bows for both target shooting, as well as hunting.

SUMMARY OF THE INVENTION

It is among the principal objects of the present invention to provide a relatively simple attachment to be affixed to a face of the bow within the window area thereof and including a base member adapted to be affixed thereto by pressure-sensitive cement or otherwise, and one end of a flexible leaf is connected to the base member in offset relationship thereto and, when mounted upon the bow, extends downwardly from the lower edge of the base member in order that the head may be disposed in cooperation with known rests or supports commonly employed and, for example, comprising a plunger member projecting outwardly from the face of the bow to engage the side of the shaft of an arrow and any of a number of rests or supports which engage the lower surface of the shaft of an arrow when in shooting position, the purpose of the attachment being to provide in conjunction with the known support members, a three-point support for an arrow when mounted in the window in shooting position and from which the arrow cannot be accidentally dislodged regardless of the position within which the bow is disposed, and particularly when the same is arranged horizontally with the window thereof disposed downwardly.

Another object of the invention is to provide on the base member a bracket arm which projects laterally therefrom and to which one end of the flexible leaf is adjustably attached for purposes of disposing the heads with cam means thereon at a preferred location with respect to the known support members and thereby adapt the attachment for use with arrows of different diameters or for different degrees of wedging the arrow by the cam means on the head against the known supports but without detrimentally affecting the shooting of the arrow from said support means.

A further object of the invention is to connect said one end of the flexible leaf with the bracket arm by means of a nut and bolt which affords reversibility of the flexible leaf and cam-type head thereon for adaptation of the attachment to the face of either a left-hand bow or a right-hand bow.

Still other improvements are provided in the attachment to render the use and connection thereof to a bow more advantageous and the attachment of which to a bow is facilitated.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT OF THE INVENTION

Figure 1:
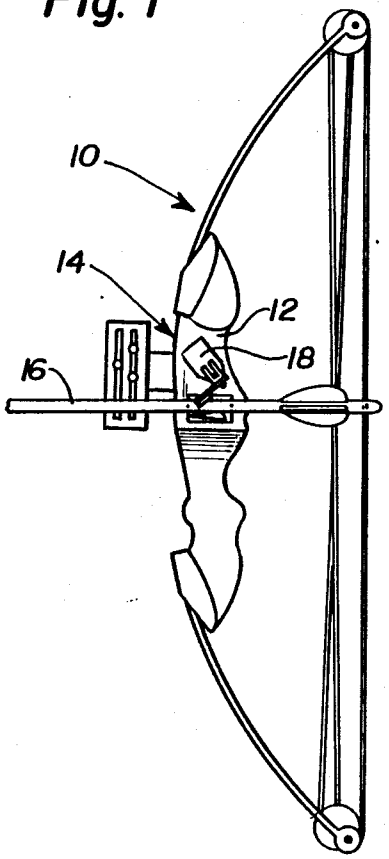
FIG. 1 is a side elevation of an exemplary bow to which the attachment comprising the present invention is illustrated in operative position thereon.

Referring to the drawings, FIG. 1 illustrates an exemplary bow 10 similar to many employed in both target shooting as well as hunting. The center portion of the bow has a face 12 comprising a window notch or space 14, best shown in side view in FIG. 3. A fragmentarily illustrated portion of the shaft of an arrow 16 is shown secured in operative position by the attachment 18 comprising the present invention.

Figure 3:
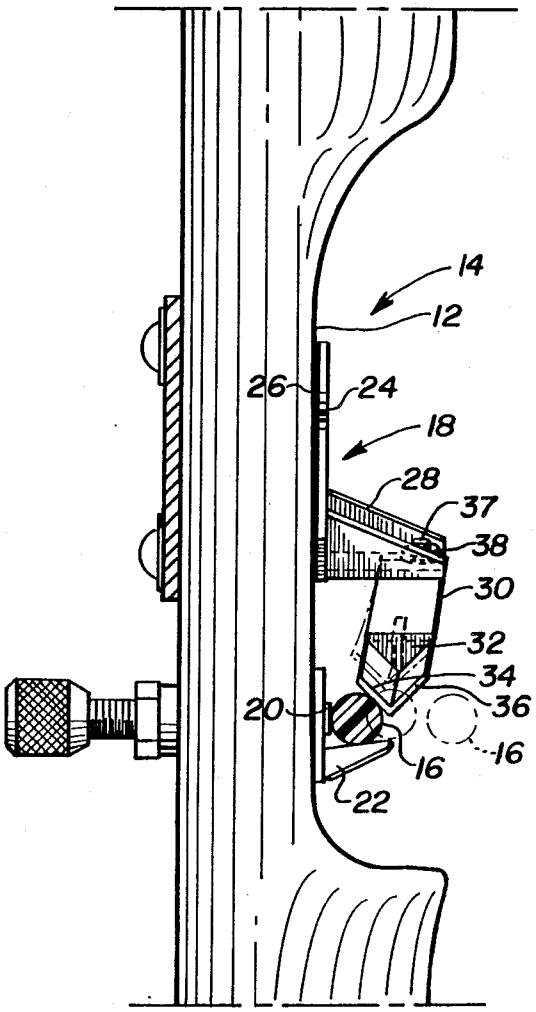
FIG. 3 is a fragmentary end elevation of FIG. 2, as seen from the left-hand side thereof and illustrating in full lines and phantom the function of the flexible leaf of the invention and the cam head thereon.
Figure 2:
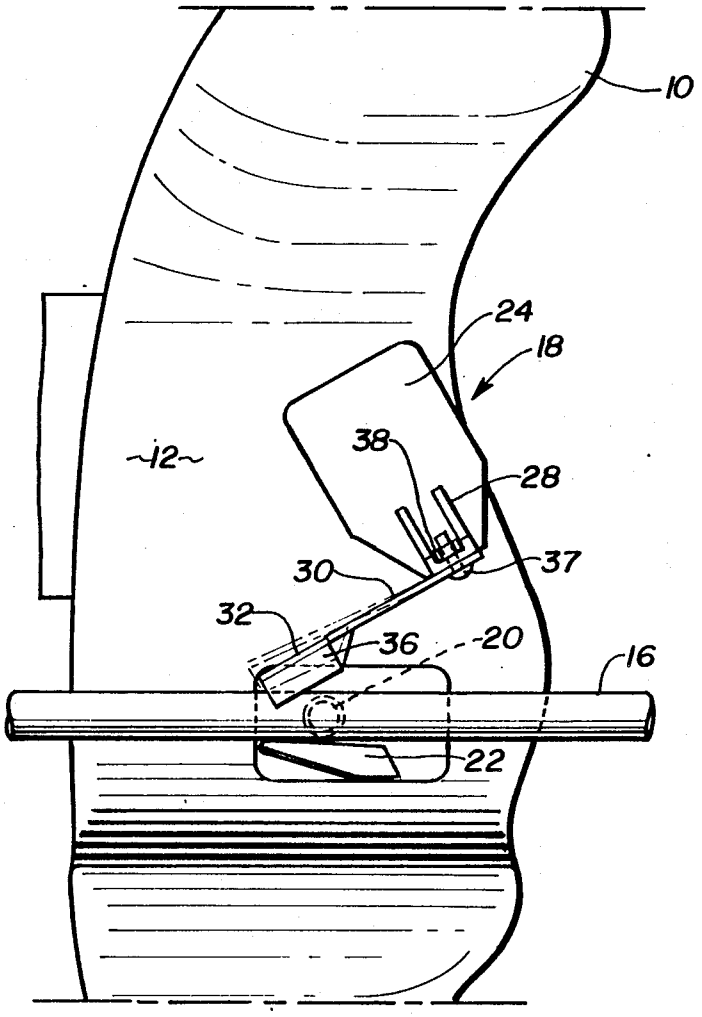
FIG. 2 is a side elevation of a central fragment of FIG. 1 on a greatly enlarged scale, showing in greater detail the function of the attachment of the invention with respect to the known support means.

As mentioned hereinabove, the attachment 18 comprising the present invention is adapted to be used in conjunction with known rests or supporting means presently in wide use in archery shooting. For example, as shown in FIGS. 2 and 3, one such known means comprises a plunger 20 and a laterally-extending rest 22 upon which the arrow rests and the plunger 20 engages one side of the arrow 16, as shown in FIG. 3. It is obvious that without the use of the attachment 18, the shaft 16 of the arrow can only be retained upon the rest 22, for example, only when the bow is disposed substantially in vertical position, as shown in FIG. 3, or in any position rotated counter-clockwise to that shown in FIG. 3, but not when rotated clockwise respective to position of FIG. 3. Hence, the need for the attachment of the present invention is obvious.

The attachment 18 comprises a relatively flat base member 24 which, for example, may be secured to the face 12 of the bow 10 by pressure-sensitive cement applied to the opposite face of the base from that shown in FIG. 2, and as indicated by the line 26 in FIG. 3. When commercially sold or distributed, pressure-sensitive cement will be covered by a protecting sheet of conventional nature until ready to be applied to the face 12. The base member 24 expeditiously may be formed inexpensively from suitable plastic, preferably of a stiff nature, and a bracket arm 28, preferably channel-shaped, as clearly shown in FIG. 2, is integrally molded to the base member 24.

A flexible leaf 30, also preferably manufactured from plastic but selected to have limited flexibility when cured, comprises an important part of the present invention, and the same is formed with a cam-type head 32 on the opposite end of the leaf from that which is attached to bracket arm 28. The head 32 has a pair of angularly-related camming faces 34 and 36 and the detailed manner in which these faces are formed is best illustrated in FIGS. 5–7.

Referring to FIG. 2, it will be seen that the flexible leaf 30 extends downwardly with respect to the lower portion of the base member 24 and outwardly away from it, whereby the cam head 32 is free to flex upwardly away from the known support 22, for example, as when an arrow shaft 16 is being mounted upon the known supports 20 and 22, such as by being moved from the outermost phantom position thereof, shown in FIG. 3, at the right-hand side laterally against the cam face 36 which cams the head upwardly away from the known support 22 to the intermediate phantom position in which the flexed leaf and head 32 are illustrated in phantom in FIG. 3, and further lateral movement of the arrow shaft toward the bow face 12 causes the head 32 to move to the phantom position shown in FIG. 3 in full lines, wherein face 34 of the head 32 is shown engaging the shaft 16 and urging it against both the known supports 20 and 22.

Attachment of the flexible leaf 30 to the base member 24 is accomplished readily by simple means, such as a bolt 37 and nut 38, the nut being illustrated in FIGS. 2 and 3 as being disposed between the sidewalls of the channel-shaped bracket arm 28, whereby it cannot rotate and a slotted head of the bolt 37 to be rotated relative to the nut to secure connection of the leaf 30 to the bracket arm 28.

Figure 5:
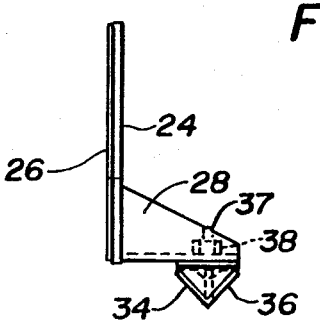
FIG. 5 is a side elevation of FIG. 4 as seen from the left-hand side thereof.
Figure 7:
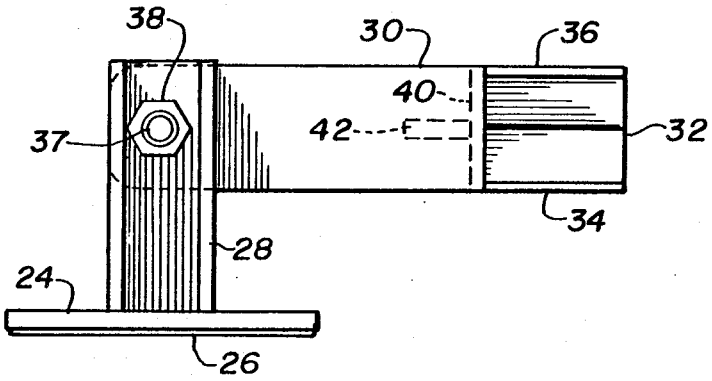
FIG. 7 is a reverse elevation to that shown in FIG. 6 and illustrating in full lines the structure of certain portions of said attachment.
Figure 4:
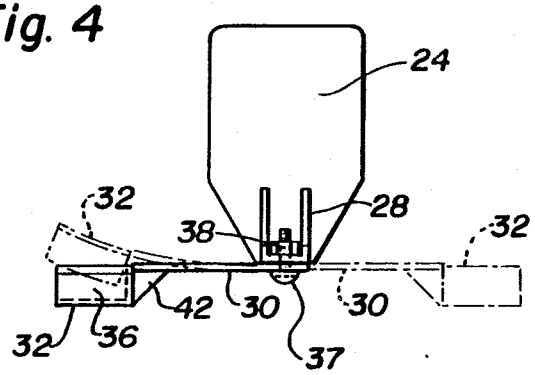
FIG. 4 is a top plan view of the attachment per se detached from a bow and showing in full lines one position of the flexible leaf with respect to the base member and in phantom, showing a reverse position of the flexible leaf, said positions respectively pertaining to left-hand and right-hand bows and, at the left-hand side of said figure, there being a phantom illustration of a cammed position of the head on the flexible leaf.
Figure 6:
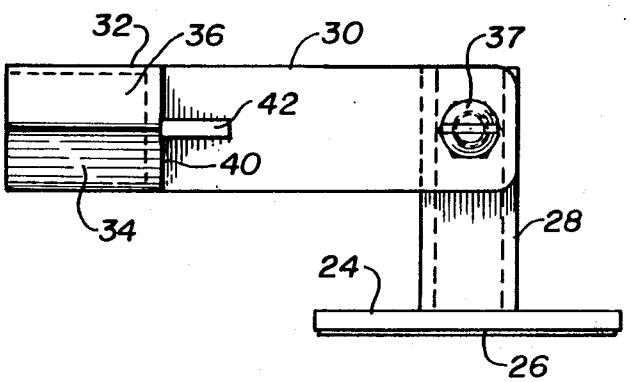
FIG. 6 is a vertical elevation of the attachment per se, illustrated on a substantially larger scale than that employed in FIGS. 4 and 5.

Referring especially to FIGS. 5–7, in particular it will be seen that the cam head 32 is not solid but, instead, comprises a pair of camming faces 34 and 36, the same extending from an end wall 40, best shown in FIGS. 6 and 7, which is perpendicular to the flexible leaf 30 and further, to strengthen the structure, a triangular gusset 42 is also integrally molded with the end wal 40 and one face of the flexible leaf 30.

From the foregoing, it will be seen that the present invention comprises a relatively simple but highly effective and useful attachment that can be applied to the face of a bow in the window thereof for use in conjunction with either previously applied known support members or newly applied ones and cooperate in conjunction with the same to support the shaft of an arrow in shooting position upon the bow and from which the same may not accidentally be dislodged even when the bow is supported upside down, as it were, in which the bow is more or less horizontal and the window opens downwardly. The attachment comprises two principal members which are readily connected by simple means, such as a nut and bolt, and in view of the adjustable connection thus afforded, it is possible to position the flexible leaf in one of two substantially opposite positions respectively useful in right-hand or left-hand bows and said connecting means also permit the flexible leaf to be adjusted with respect to the cam-type head thereof being best positioned with respect to the known support means with which it cooperates.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An attachment for a bow for use in conjunction with a known support which is affixed to the face of the bow and engages the lower and at least one side surface of the shaft of an arrow to secure it against falling from such support means regardless of the position of the bow when held for shooting, said attachment comprising in combination, a base member adapted to be affixed to the flat face of a bow, a flexible leaf having one end affixed to said base member and laterally offset from the outer face of said base member and extending downwardly at an angle away from the lower edge of said member when mounted in operative position upon a bow, and an arrow-engaging head mounted upon the outer end of said leaf and having a cam surface and another surface, said cam surface being slidably engageable with an upper surface of the shaft of an arrow to raise said head when said shaft is moved laterally upon said known support toward the face of the bow, and as the shaft moves past said cam surface said head moves downward and engages said shaft with said another surface of said head to hold the same upon said known support and secure it against falling from the bow when the bow is provided with said other known supports engageable with the lower and inner side surfaces of the shaft of an arrow, thereby generally in a three-point support manner.

2. The attachment according to claim 1 in which said another surface of said arrow-engaging head on said leaf slopes downward and outward relative to the plane of said base member when secured to said face of a bow and is operable resiliently to wedge the shaft of the arrow toward said face of a bow to which said base member is attachable and into engagement with said known support.

3. The attachment according to claim 2 in which said cam surface on said head extends upward and outward from the lowermost edge of said another surface and is operable to be engaged laterally by the arrow shaft to cam the head upward as aforesaid to facilitate positioning said another surface upon the arrow shaft to position the shaft in a secured position upon the bow.

4. The attachment according to claim 1 in which said base member is provided with a bracket arm fixed thereto and projecting laterally therefrom, and one end of said leaf being reversibly and detachably secured thereto for rendering the leaf capable of being disposed in one of several reversed positions with respect to said bracket arm and thereby adapt the attachment to be affixed to the operative face of either a right-hand or left-hand bow.

5. The attachment according to claim 1 in which said leaf is adjustably secured at one end relative to said base member to permit limited pivotal movement operable to dispose said arrow-engaging head at adjusted spacings from said base member and thereby effect a desired degree of wedging of an arrow shaft by said head against said known supports.

* * * * *